US006041712A

United States Patent [19]

Lyon

[11] Patent Number: 6,041,712

[45] Date of Patent: Mar. 28, 2000

[54] NON-LETHAL CARTRIDGE WITH SPIN-STABILIZED PROJECTILE

[75] Inventor: David H. Lyon, Street, Md.

[73] Assignee: The United States of America as represented by the Secretary of the Army, Washington, D.C.

[21] Appl. No.: 08/986,987

[22] Filed: Dec. 11, 1997

[51] Int. Cl.[7] ..... F42B 5/02; F42B 8/02

[52] U.S. Cl. ..... 102/439; 102/444; 102/502; 102/517; 102/519; 102/529

[58] Field of Search ..... 102/430, 439, 102/444–447, 498, 501, 502, 513, 517, 519, 524–527, 529

[56] References Cited

U.S. PATENT DOCUMENTS

| | | | |
|---|---|---|---|
| 228,494 | 6/1880 | Valentine | 102/447 |
| 3,714,896 | 2/1973 | Young | 102/517 |
| 4,164,903 | 8/1979 | Bouza | 102/444 |
| 5,086,703 | 2/1992 | Klein | 102/502 |
| 5,259,319 | 11/1993 | Dravecky et al. | 102/444 |
| 5,402,729 | 4/1995 | Richert | 102/447 |

FOREIGN PATENT DOCUMENTS

| | | | |
|---|---|---|---|
| 204107 | 12/1986 | European Pat. Off. | 102/444 |
| 4016001 | 11/1991 | Germany | 102/444 |
| 10288 | of 1904 | United Kingdom | 102/444 |
| WO 83/00213 | 1/1983 | WIPO | 102/430 |

*Primary Examiner*—Harold J. Tudor
*Attorney, Agent, or Firm*—Paul S. Clohan; Mark D. Kelly; William E. Eshelman

[57] ABSTRACT

The invention is a non lethal weapon cartridge comprising a projectile and a means for propelling the projectile through a weapon barrel. A munition of this type can be employed by soldiers during operations-other-than-war, such as riot control during humanitarian missions, or by law enforcement personnel when a lethal response is not warranted. The projectile comprises a full-bore projectile body fitted with a compliant nose. The projectile is designed to be spin-stabilized such that it will fly, and impact, nose first, while describing a ballistic trajectory. The projectile is intended to be launched from a rifled weapon tube. The rifling imparts the spin necessary to achieve dynamic stability. The propulsion system utilizes a modern smokeless propellant in combination with a high-low technique to produce consistent interior ballistics.

8 Claims, 6 Drawing Sheets

NON-LETHAL CARTRIDGE WITH SPIN-STABILIZED PROJECTILE

BACKGROUND OF THE INVENTION

The present invention relates in general to non lethal kinetic energy projectiles, and in particular to spin-stabilized non lethal kinetic energy projectiles.

In general, previous non lethal kinetic energy projectiles have been designed for relatively short range encounters, usually in the 7 meter to 15 meter range. To achieve a high probability of hit on a specific human target, at these ranges, a high degree of ballistic accuracy is not necessary. It is quite possible to obtain this level of performance from an aerodynamically unstable projectile. However, hit probability diminishes rapidly when attempting to engage beyond these ranges. This is due to inconsistent aerodynamic forces generated by unstable, and possibly inconsistent, projectile shapes.

Existing designs include fabric bags which are filled with lead shot. These are sewn into a square or a round pancake-shaped geometry, then folded to fit into an appropriate cartridge case over a gas seal. After gun launch, these "bean-bags" are not physically constrained, resulting in flight body shapes which vary over the trajectory. As such, the resulting shape, and aerodynamic forces generated by that shape, are extremely inconsistent. These discrepancies cause consequential changes in both the drag and lift forces, producing significant deviations from the intended trajectory. Furthermore, these bean bags typically assume a high drag shape during flight, rapidly losing velocity and energy.

Another category of non lethal projectile consists of a single, or multiple, right circular cylinder(s). Generically referred to as "rubber bullets", these items are typically constructed of hard rubber, foam, plastic, or wood. It is possible to achieve aerodynamic stability with such a projectile, but only if the proper spin rate is imparted. However, the majority of these devices are launched from a smoothbore tube, and therefore, tumble in flight. In addition, they have a flat forward face which once again results in a high drag shape.

In order to achieve the desired level of performance, a spin-stabilized projectile with a low drag shape is preferred. This would allow the projectile to reach a range significantly greater than current state-of-the-art non lethal projectiles, without losing considerable velocity, while maintaining a predictable flight path.

The method of propulsion typically employed for previous designs included a charge of black powder which was ignited by a percussion primer. The reduced mass and low velocity required for non lethal projectile applications restricts the working pressure to a level that modern smokeless powders will not deflagrate (burn) consistently. This generally produces large deviations in muzzle velocity and often leaves partially consumed powder in the cartridge case and weapon bore. The one attractive characteristic of black powder is its propensity to burn consistently at lower pressure, providing excellent performance for non lethal munitions. However, the burning of black powder also produces heavy, corrosive residue. This residue can quickly accumulate to the point of adversely affecting weapon performance. In order to avoid a degradation in effectiveness, the weapon barrel requires frequent cleaning. In addition, the corrosive products attack metallic components. Therefore, especially for military applications, the disadvantages of black powder can outweigh the benefits.

The present invention exhibits several advantages over previous designs. First, it is a projectile designed to impart a non lethal impact to a human target from a wide range of distances. This specific design utilizes spin-stabilization, in combination with a low drag shape. These characteristics allow the projectile to maintain low dispersion and retain adequate terminal velocity to remain effective at extended ranges. Second, it contains a compliant nose which compresses to absorb energy upon impact. This technique reduces the likelihood of skin abrasion, laceration, skeletal or organ damage by more evenly distributing the force over the impact site.

The nose material also modifies the impulsive force, by increasing the time and decreasing the magnitude over which the impact energy is transferred to the target. This is an advantage over designs which employ non-compliant materials. Third, it is propelled by a modern smokeless propellant which is burned at a higher pressure and controllably vented into the weapon chamber to work upon the projectile base. This "high-low" technique provides much greater consistency in muzzle velocity when compared to a conventional single-stage propulsion system producing similar interior ballistics. Lastly, this cartridge is designed to be fired from several existing U.S. military weapons with no modifications.

SUMMARY OF THE INVENTION

It is an object of the present invention to provide a projectile for imparting a non lethal impact to a human target over a wide range of distances.

It is another object of the invention to provide a non lethal projectile that utilizes spin-stabilization, in combination with a low drag shape.

It is a further object of the invention to provide a non lethal projectile that uses a compliant nose which compresses to absorb energy upon impact.

It is yet a further object of the invention to provide a non lethal projectile that is propelled by a modern smokeless propellant which is burned at a higher pressure and controllably vented into the weapon chamber to work upon the projectile base.

It is still a further object of the invention to provide a non lethal projectile that may be fired from several existing U.S. military weapons.

These and other objects of the invention are achieved by a non lethal weapon cartridge comprising a projectile including a projectile body and a nose; the projectile body being generally cylindrical and hollow and including a bore-riding surface, a rotating band, an undercut and one open end; the nose being made of a compliant material; a housing connected to the projectile, the housing including a lip for engaging the undercut of the projectile; and a propulsion system disposed in an opening in the housing, the propulsion system comprising a cartridge case, propellant disposed in the cartridge case and a primer for igniting the propellant.

In one embodiment, the propulsion system further comprises an outer sleeve into which the cartridge case is inserted, the outer sleeve defining a vent hole at a nose end of the outer sleeve; and a diaphragm which covers the vent hole at the nose end of the outer sleeve.

In another embodiment, the propulsion system further comprises a plug inserted in the cartridge case wherein an end of the cartridge case is crimped to retain the plug.

In still another embodiment, an end of the cartridge case is completely crimped shut.

Another aspect of the invention is a non lethal weapon comprising a non lethal weapon cartridge and means for launching the non lethal weapon cartridge, the means for launching including a rifled weapon tube wherein an inside diameter of the rifled weapon tube is substantially the same as an outside diameter of the non lethal weapon cartridge.

Further objects, features and advantages of the invention will become apparent from the following detailed description taken in conjunction with the accompanying drawings.

DETAILED DESCRIPTION OF THE PREFERRED EMBODIMENTS

Figure 1:
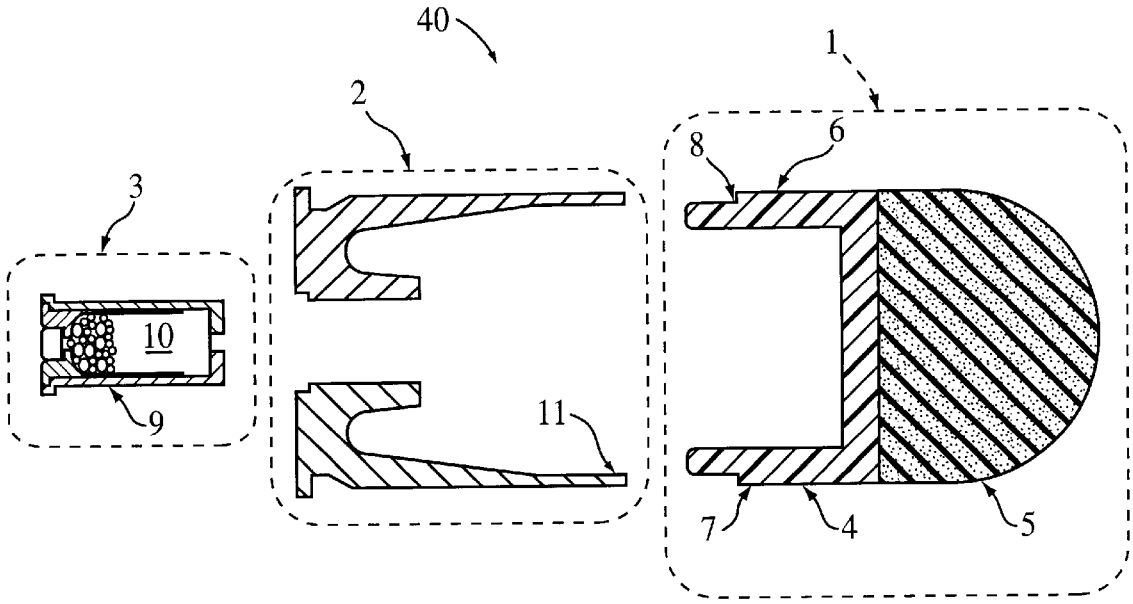
FIG. 1 is an exploded cross-sectional view of a cartridge according to the invention.

The invention is a weapon cartridge comprising a projectile and a means for propelling the projectile through the weapon barrel. A munition of this type can be employed by soldiers during operations-other-than-war, such as riot control during humanitarian missions, or by law enforcement personnel when a lethal response is not warranted.

The projectile comprises a single full-bore, projectile body fitted with a compliant nose. The projectile is designed to be spin-stabilized such that it will fly, and impact, nose first, while describing a ballistic trajectory. The projectile is intended to be launched from a rifled weapon tube. The rifling imparts the spin necessary to achieve dynamic stability. The projectile is full-bore, in relation to the launch tube.

The nose material and shape are selected to absorb impact energy, thereby reducing the potential for injury. The nose of the non lethal projectile is designed to absorb and redistribute energy during impact in order to minimize the level of injury to the target.

The majority of the interior of the non lethal projectile body is hollow. This allows a concentration of the projectile mass near the outer diameter, resulting in additional gyroscopic stability.

The propulsion system allows the use of a modern smokeless propellant to launch a low mass projectile at a greatly reduced velocity, compared with typical ordnance velocities. In addition, the propulsion system results in repeatable muzzle velocities.

The weapon cartridge housing may be injection molded from, for example, glass-reinforced nylon, and contains the propulsion system. The propulsion system comprises a metallic small-arms cartridge case which contains a percussion primer and powder charge, and a means of venting propellant gases into the weapon chamber in a controlled manner. The small-arms cartridge case includes a primer pocket, flash hole, and an interior cavity to accommodate a propellant charge. It is structurally designed to contain the high pressure produced during propellant burn, then vent the combustion products into the weapon chamber.

After primer initiation, the propellant begins to burn inside the small-arms cartridge case, which acts as a pressure vessel to momentarily contain the combustion products. In a preferred embodiment, the small-arms cartridge case is inserted into a cartridge adaptor (outer sleeve). The outer sleeve includes a vent hole. When pressure inside the outer sleeve builds to an appropriate level, a vent area is activated. This can be achieved by means of a vent hole, or holes, initially covered by a burst diaphragm. The pressure inside the outer sleeve increases until it overcomes the resistance offered by the diaphragm and ruptures the material covering the vent hole(s).

The small-arms cartridge case is prepared for assembly by first pressing a percussion primer in the primer pocket. Then the propelling charge is loaded into the small-arms cartridge. A hole through the end of an outer sleeve functions as the vent hole. This hole is initially covered by a thin diaphragm material. The small-arms cartridge case arrangement is then inserted into the outer sleeve. Finally, this assembly is secured in the weapon cartridge case.

In an alternative embodiment, a small-arms cartridge case with a star, or rosette, crimp is employed as the propulsion system. The small-arms cartridge case is loaded in a similar manner as that described above, only the rosette crimp serves to contain the propellant gases until the interior pressure is great enough to force the crimp open, functioning as a vent to the weapon chamber. Such a technique utilizes the small-arms metallic cartridge case as the cartridge adaptor or outer sleeve, with the open end crimped closed. Upon function of the vent area, the interior of the metallic cartridge case is open to communicate the combustion products into the remaining volume of the weapon chamber. Here they act upon the base of the projectile to propel it through the weapon launch tube. Referred to as a "high-low" system, this propulsion technique allows a modern smokeless small-arms propellant to burn at an elevated pressure, where it will be consumed in a consistent fashion. It also allows the combustion products to be vented into the weapon chamber, in a controlled manner, where they act to accelerate the low mass projectile in a repeatable manner.

In another embodiment, a small-arms cartridge case is prepared in a similar fashion. However, a disk, or plug, of material is placed over the propellant. This disk is typically made from a material such as chipboard, so it can be forced through a smaller opening. The open end of the small-arms cartridge case is then rolled over to form a retaining crimp. As the pressure increases, the plug is forced past the crimp and through a restriction in the weapon cartridge case, allowing the combustion gases to vent into the weapon chamber.

The invention is designed to be launched from several existing military weapons to include the M79 and M203 40-mm Grenade Launchers.

In operation, the percussion primer is initiated by the weapon firing pin. The primer ignites the powder charge which increases the pressure within the small-arms cartridge case. The pressure increases and ruptures the diaphragm material covering the vent hole, allowing propellant gases to escape into the weapon chamber. The pressure increases within the weapon chamber which forces the projectile to unseat from the cartridge case and accelerate through the weapon barrel. The projectile rotating band engages the bore rifling, transmitting a torque about the projectile centerline axis. The induced spin is sufficient to gyroscopically stabilize the projectile throughout a ballistic trajectory, impacting nose forward. The nose material and nose shape absorb a portion of the impact energy and distribute the remaining energy more uniformly over the impact site. The nose material also expands on impact, increasing the area of the impact site, thereby further reducing the risk of lethal injury to the target.

The invention, according to FIG. 1, is a weapon cartridge 40 comprising three major components; the projectile 1, the housing 2, and the propulsion system 3. The projectile 1 is comprised of the projectile body 4 and the nose 5. The body 4 is full-bore in diameter and constructed of a lightweight material such as plastic. The projectile body 4 includes a bore-riding surface 6, a rotating band 7, and an undercut 8 for retention in the weapon cartridge housing 2. The projectile nose 5 is fabricated from a low density material such as foam and is contoured to result in low drag. The projectile body 4 is attached to the nose 5 by an adhesive and/or mechanical means along common surfaces. The housing 2 can be metallic or injection molded plastic in construction and serves to retain the projectile 1 and propulsion system 3 as well as prevent gas leakage into the breech area of the weapon. The propulsion system 3 includes a propellant charge 9 and a free volume 10 for the accumulation of combustion gases, in addition to a means of venting these gases into the weapon chamber.

Figure 2:
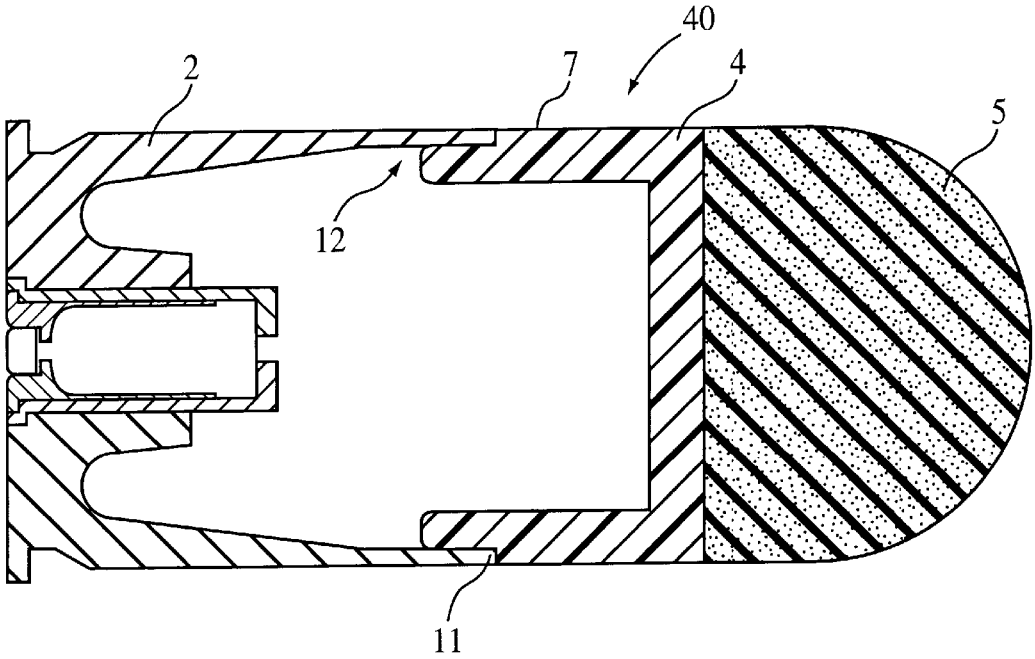
FIG. 2 is an assembled cross-sectional view of a cartridge according to the invention.

The projectile 1 is secured to the housing 2 by an interference fit. This causes a lip 11 on the mouth of the weapon cartridge housing 2 to engage an undercut 8 in the projectile body 4. Referring to FIG. 2, a bead of sealant 12 is applied to prevent the entry of moisture or the accidental separation of the projectile.

Figure 3:
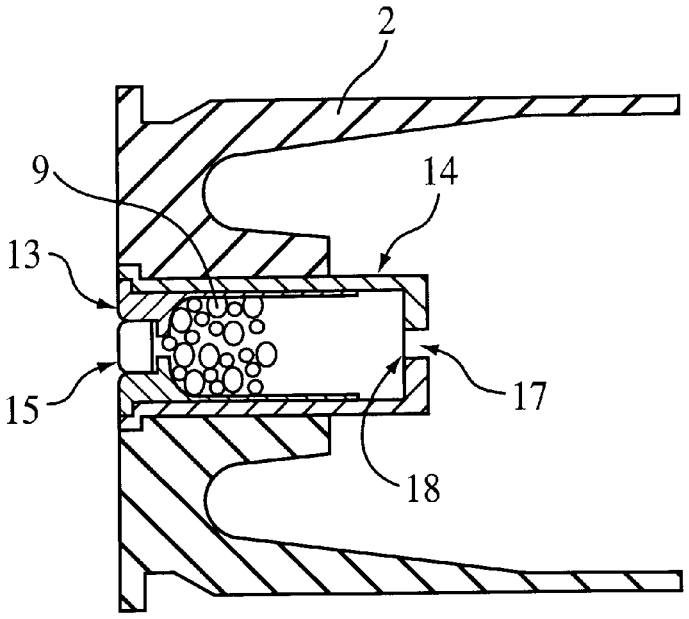
FIG. 3 is a cross-sectional view of one embodiment of a propulsion system.
Figure 4:
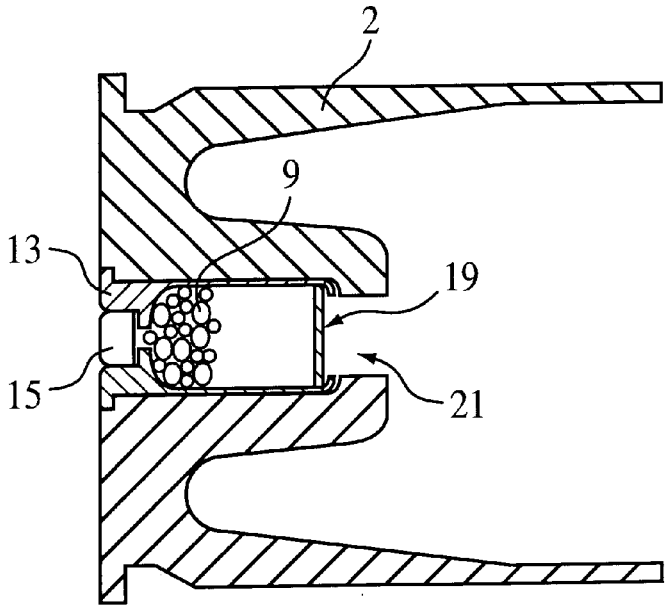
FIG. 4 is a cross-sectional view of an alternative embodiment of a propulsion system.

Details regarding several possible configurations of the propulsion system 3 are illustrated in FIGS. 3 and 4. In the embodiment of FIG. 3, the propulsion system 3 comprises two components; a metallic small-arms caliber cartridge case 13, and an outer metal sleeve 14 into which the small-arms cartridge case is inserted. The small-arms cartridge case 13 serves to secure a small-arms percussion primer 15 and a charge of smokeless propellant 9.

As shown in FIG. 3, the sleeve 14 offers structural reinforcement to the small-arms cartridge case 13 and contains a vent hole 17 at the otherwise solid end. The sleeve 14 provides the strength necessary to contain the high pressure gases produced during propellant combustion. The vent hole 17 is initially covered by a diaphragm 18.

FIG. 4 illustrates an alternative means of venting the propellant gases from within the small-arms cartridge case 13 to the weapon chamber. After loading the appropriate propellant charge 9, a plug of material 19 is inserted into the small-arms cartridge case 13. Then the forward, or open, end of the small-arms cartridge case is crimped to retain the plug 19. This secures the propellant 9 and offers mechanical resistance until the propellant gas pressure reaches a level that opens the crimp. After opening the crimp, the pressure inside the small-arms cartridge case forces the plug 19 through a restriction 21, allowing the gases to vent into the weapon chamber.

Figure 9:
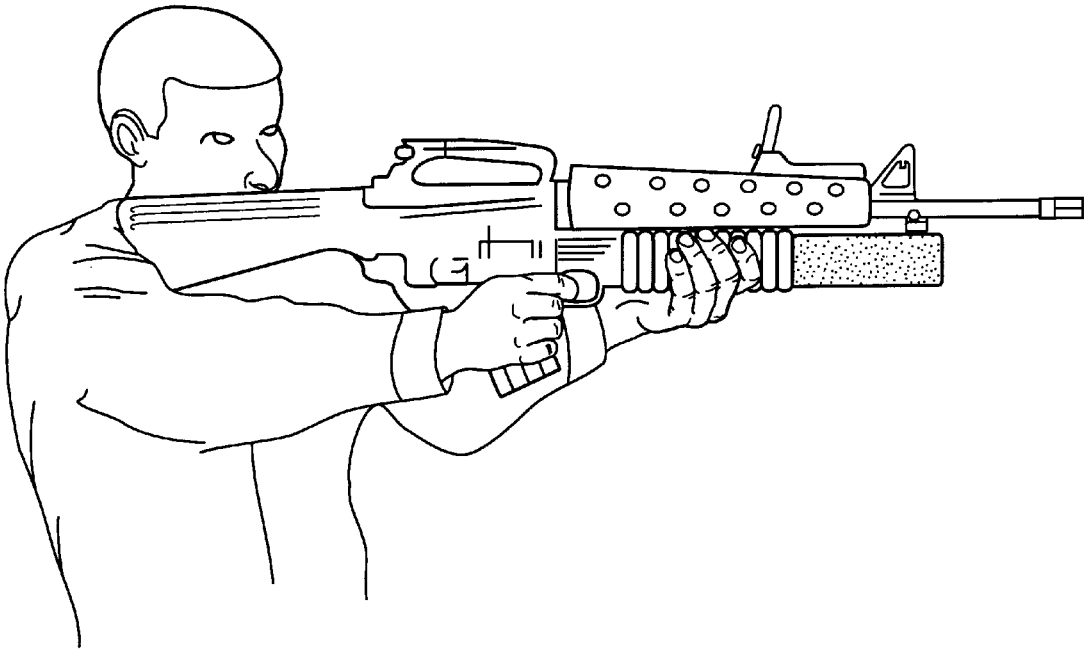
FIG. 9 shows a soldier aiming a rifle-mounted grenade launcher for launching a non-lethal projectile according to the invention.
Figure 10:
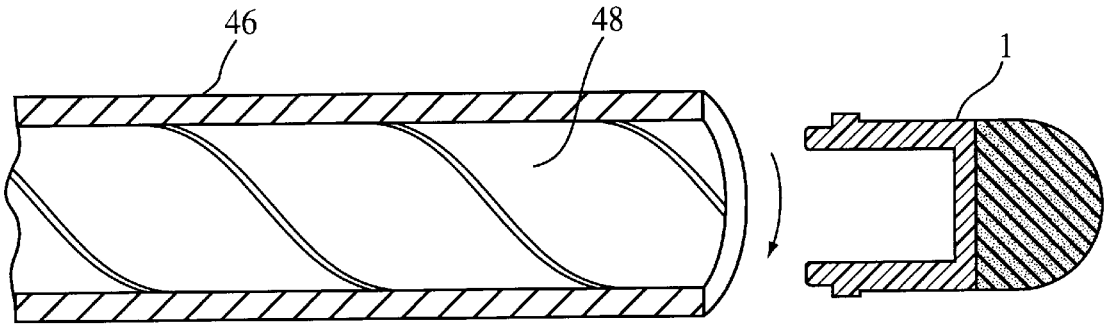
FIG. 10 is a cross-sectional view of a rifled weapon barrel and a non-lethal weapon projectile according to the invention.

In operation, the cartridge 40 is loaded into a suitable launch weapon such as grenade launcher 42 attached to rifle 44 of FIG. 9. The primer 15 is struck by the weapon firing pin which initiates the primer compound and, subsequently, the powder charge 9. As the propellant burns, the pressure inside the metallic, small-arms cartridge case 13 increases to the point that the diaphragm material 18 ruptures, and the gases begin to expel through the vent hole 17. As the pressure in the weapon chamber increases, the projectile 1 unseats from the housing 2. The projectile 1 then accelerates down the barrel 46 of grenade launcher 42 while engaging the bore rifling 48, which transmits spin torque to the projectile 1 as illustrated in FIG. 10. After firing, the weapon breech can be opened, the spent housing 2 extracted, and a fresh cartridge 40 inserted.

The use of high-strength plastic (Thermoplastic Polyester) allows for a lightweight projectile body 4. The interior of the body 4 may be hollowed-out to increase stability and further reduce mass. One embodiment uses a nose 5 made of a foam material comprising a natural rubber compound. While this material provides the required stiffness and capacity to absorb energy, it may degrade with exposure to sunlight and ozone, therefore creating potential shelf life and storage problems. Another material for the nose 5 is a closed-cell foam made from polyolefin. This material possesses several advantages over natural rubber. These include a synthetic resin base that is highly resistant to chemicals and environmental exposure. In addition, this foam lends itself to thermoforming and profile cutting, which are attractive properties for mass production.

FLIGHT PERFORMANCE

Figure 5:
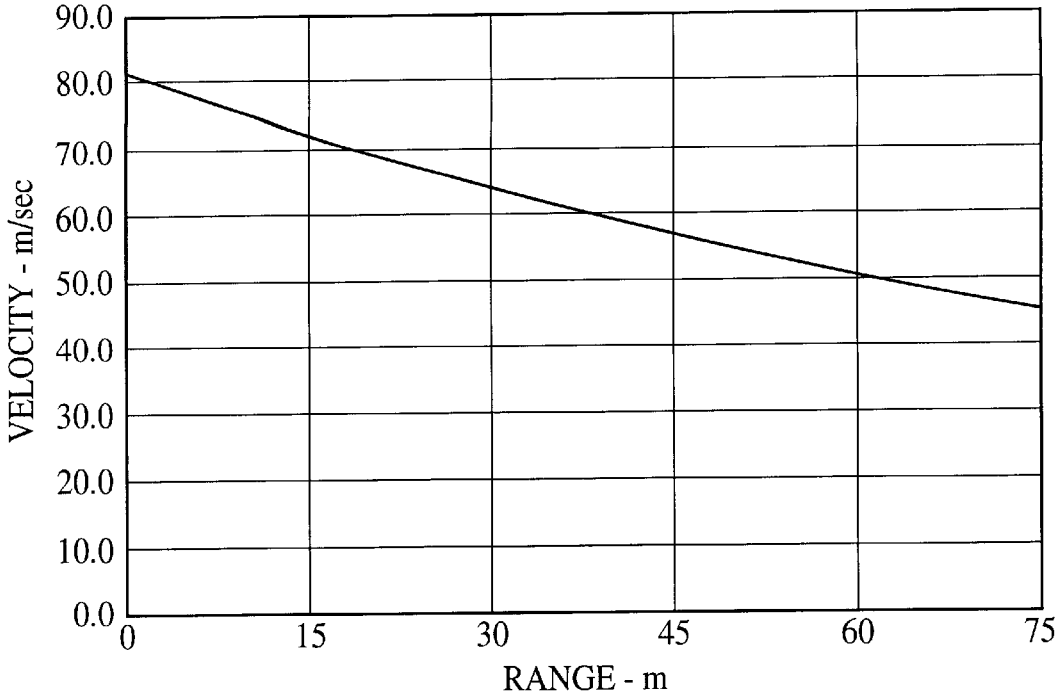
FIG. 5 is a plot of velocity versus range.
Figure 6:
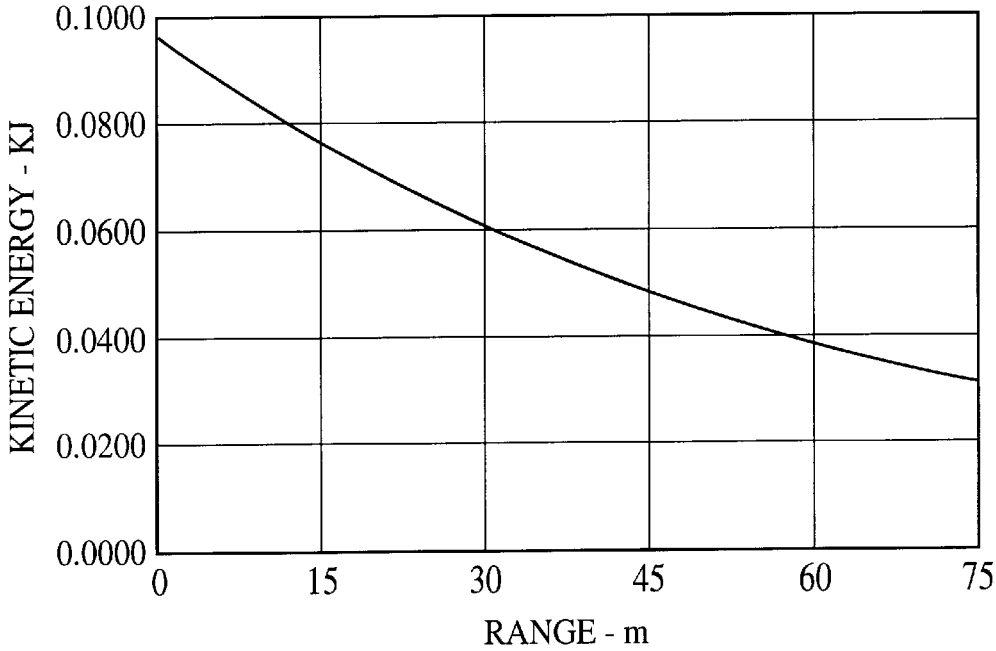
FIG. 6 is a plot of kinetic energy versus range.

Performance data for the invention has been derived from a combination of experimental firings and computational efforts. A summary of the projectile physical properties, stability, and aerodynamic coefficients are shown in Table 1. A muzzle velocity of 81 m/s was deemed an adequate compromise between effectiveness, potential lethality, and ballistic trajectory. This launch velocity will result in the velocity versus range curve of FIG. 5, as well as the kinetic energy versus range curve of FIG. 6.

Figure 7:
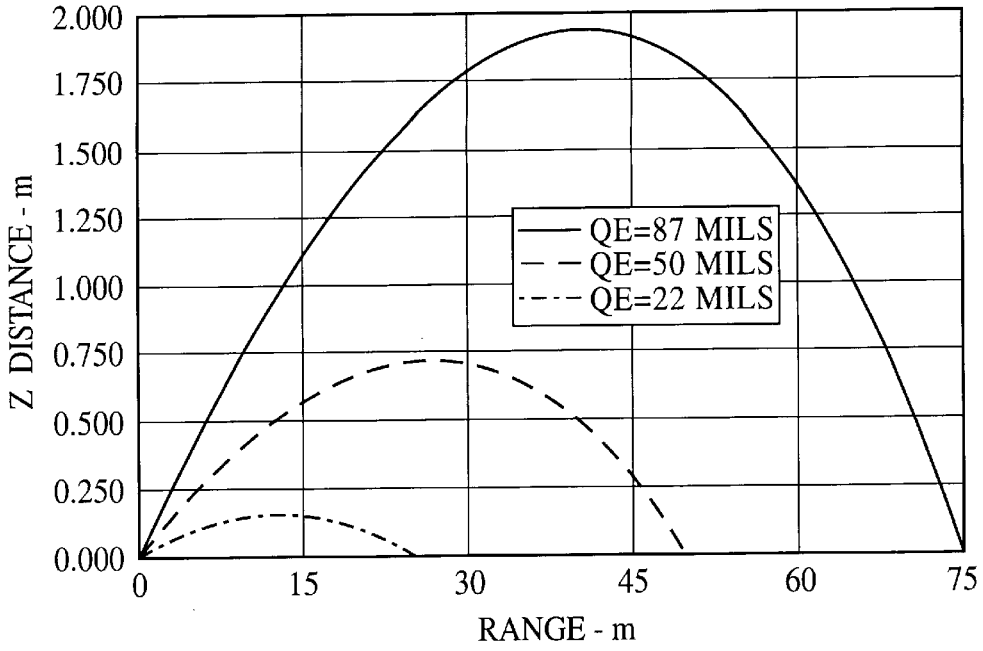
FIG. 7 shows trajectory curves for various launch angles.

The drag coefficient at zero angle of attack ($C_{Do}$) was determined to be 0.25 over the mach numbers experienced during flight. With this information a series of two-dimensional trajectory calculations were conducted for various ranges, included as FIG. 7. These illustrate the weapon elevation required for each range and the height of apogee. A twenty round group of prototype cartridges, fired at a 30 meter target, resulted in a dispersion of 1.69 milliradians in the horizontal and 5.29 milliradians in the vertical.

TABLE 1

| Projectile Characteristics | | | | | |
|---|---|---|---|---|---|
| Mass (gm) | Diameter (mm) | Length (mm) | Moments of Inertia (gm-cm$^2$) | $C_G$ from nose (mm) | Gyroscopic Stability Factor ($S_g$) @ 81 m/s |
| 30.0 | 40.6 | 65.4 | Axial = 80.7<br>Transverse = 97.9 | 44.0 | 1.3 |

INTERIOR BALLISTIC PERFORMANCE

Figure 8:
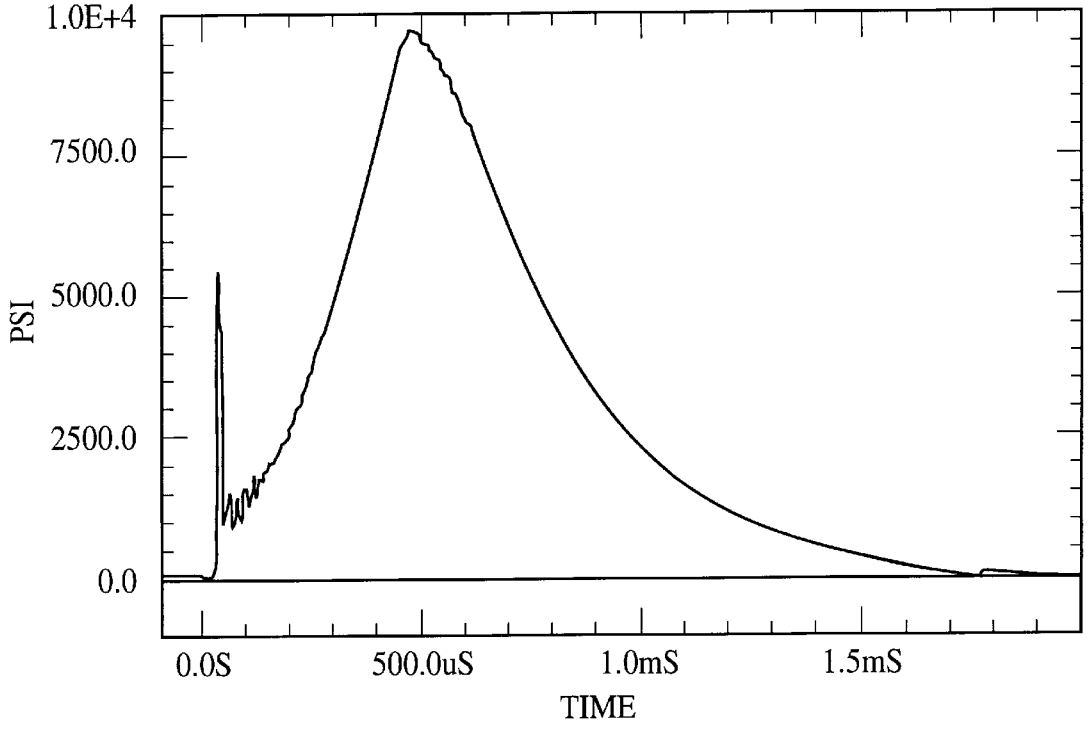
FIG. 8 is a pressure versus time curve in weapon chamber.

Parameters such as small-arms cartridge case volume, propellant charge, as well as the size of the vent hole and type of crimp may be varied. For example, acceptable and consistent interior ballistics were produced using a 0.38 Smith & Wesson cartridge case loaded with 2.0 grains of Winchester Super Target propellant in combination with a 0.100 inch diameter vent hole in the center of the outer sleeve. The peak pressure inside the small-arms cartridge case 13, shown in FIG. 8, is approximately an order of magnitude higher than the peak pressure experienced within the weapon chamber. This indicates that the high-low technique is adequately restricting the flow of propellant gases and venting in a controlled manner. A ten round group of prototype cartridges 40 produced an average muzzle velocity of 81.5 m/s, with a standard deviation of 2 m/s.

While the invention has been described with reference to certain preferred embodiments, numerous changes, alterations and modifications to the described embodiments are possible without departing from the spirit and scope of the invention as defined in the appended claims, and equivalents thereof

What is claimed is:

1. A non-lethal weapon cartridge, comprising:

a projectile comprising:

a spin-stabilized, hollow, cylindrical projectile body open at the rear end and closed at the forward end, having a solid, flat forward face and a tubular bore-riding sidewall extending rearwardly from the forward face;

a rotating band extending circumferentially about the sidewall;

an undercut extending radially inwardly from an outer surface of the sidewall;

a nose affixed to the flat forward face of the projectile body, the nose comprising a compliant material;

a housing connected to the projectile body comprising a lip engaging the undercut of the projectile body; and a propulsion system disposed in an opening in the housing, the propulsion system comprising a cartridge case, propellant disposed in the cartridge case and a primer for igniting the propellant.

2. The non-lethal weapon cartridge of claim 1 wherein the nose comprises foam rubber.

3. The non-lethal weapon cartridge of claim 2, wherein the nose is rounded to reduce air resistance during flight and is of such a stiffness that the air pressure acting on it during flight will not substantially alter its original shape.

4. The non-lethal weapon cartridge of claim 1, wherein the cartridge case is a small arms cartridge case and the propulsion system further comprises:

an outer sleeve into which the cartridge case is inserted, the outer sleeve defining a vent hole at a nose end of the outer sleeve; and a diaphragm which covers the vent hole at the nose end of the outer sleeve.

5. A non-lethal weapon comprising:

the non lethal weapon cartridge of claim 1; and means for launching the non lethal weapon cartridge, the means for launching including a rifled weapon tube wherein an inside diameter of the rifled weapon tube is substantially the same as an outside diameter of the bore-riding sidewall.

6. The non-lethal weapon system of claim 5, wherein the propulsion system further comprises:

an outer sleeve into which the cartridge case is inserted, the outer sleeve defining a vent hole at a nose end of the outer sleeve; and a diaphragm which covers the vent hole at the nose end of the outer sleeve.

7. The non-lethal weapon system of claim 5, wherein the propulsion system further comprises a plug inserted in the cartridge case and wherein an end of the cartridge case is crimped to retain the plug.

8. A non-lethal weapon system, comprising:

a projectile comprising:

a spin-stabilized, hollow, cylindrical projectile body open at the rear end and closed at the forward end, having a solid, flat forward face and a tubular bore-riding sidewall extending rearwardly from the forward face;

a rotating band extending circumferentially about the sidewall;

an undercut extending radially inwardly from an outer surface of the sidewall;

a nose affixed to the flat forward face of the projectile body, the nose comprising a compliant material, rounded to reduce air resistance during flight and is of such a stiffness that the air pressure acting on it during flight will not substantially alter its original shape;

a housing connected to the projectile body comprising a lip engaging the undercut of the projectile body; and a propulsion system disposed in an opening in the housing, the propulsion system comprising a cartridge case, propellant disposed in the cartridge case and a primer for igniting the propellant;

wherein the propulsion system further comprises:

an outer sleeve into which the cartridge case is inserted, the outer sleeve defining a vent hole at a nose end of the outer sleeve; and a diaphragm which covers the vent hole at the nose end of the outer sleeve;

and means for launching the non lethal weapon cartridge, the means for launching including a rifled weapon tube wherein an inside diameter of the rifled weapon tube is substantially the same as an outside diameter of the bore-riding sidewall.

* * * * *